United States Patent [19]

Copie

[11] Patent Number: 4,482,285

[45] Date of Patent: Nov. 13, 1984

[54] LOAD CARRIER ASSEMBLY

[75] Inventor: Fernand Copie, Minneapolis, Minn.

[73] Assignee: RayGo, Inc., Minneapolis, Minn.

[21] Appl. No.: 407,555

[22] Filed: Aug. 12, 1982

[51] Int. Cl.[3] ..... B66F 9/14

[52] U.S. Cl. ..... 414/589; 294/81 SF; 414/608; 414/632

[58] Field of Search ..... 294/81 SF; 414/589, 414/590, 608, 785, 628–633

[56] References Cited

U.S. PATENT DOCUMENTS

| | | | |
|---|---|---|---|
| Re. 27,905 | 1/1974 | Whiteman . | |
| 3,387,729 | 6/1968 | Hinden et al. . | |
| 3,387,730 | 6/1968 | Levitt . | |
| 3,493,258 | 2/1970 | Wyrough . | |
| 3,499,563 | 3/1970 | Forry et al. . | |
| 3,514,002 | 5/1970 | Allegri et al. . | |
| 3,606,053 | 9/1971 | Whiteman . | |
| 3,633,777 | 1/1972 | Snelling, Jr. et al. | 414/608 |
| 3,764,032 | 10/1973 | Ward | 414/608 |
| 3,780,877 | 12/1973 | Levitt . | |
| 3,827,743 | 8/1974 | Visser . | |
| 3,828,940 | 8/1974 | Cooper | 294/81 SF X |
| 3,870,180 | 3/1975 | Snelling, Jr. | 414/608 |
| 3,893,580 | 7/1975 | Stevens | 414/632 |
| 3,966,069 | 6/1976 | Fathauer . | |
| 3,982,644 | 9/1976 | Pease | 294/81 SF X |
| 3,984,019 | 10/1976 | Brudi et al. . | |
| 4,014,447 | 3/1977 | Whiteman et al. . | |
| 4,016,992 | 4/1977 | Larsen et al. | 214/147 G |
| 4,017,110 | 4/1977 | Pease et al. . | |
| 4,093,090 | 6/1978 | Whiteman | 294/81 SF X |
| 4,201,511 | 5/1980 | Charles . | |
| 4,268,216 | 5/1981 | Copie | 414/719 |
| 4,286,722 | 9/1981 | Tax et al. . | |

OTHER PUBLICATIONS

Publication–*Job Report*–Raygo Wagner.

Publication–Raygo Wagner, *Port Packers and Piggy Packers.*

*Primary Examiner*—Robert J. Spar

*Assistant Examiner*—Terrance L. Siemens

*Attorney, Agent, or Firm*—Burd, Bartz & Gutenkauf

[57] ABSTRACT

A cargo container handling assembly mounted on the lift beam of a mobile vehicle to transport and stack a cargo container. A bridge secured to the lift means accommodates a pair of vertically movable supports. Struts carried by the supports have balls on their upper and lower ends for movably supporting a carrier adapted to be locked onto a cargo container. Fluid operated cylinders are selectively operable to provide the carrier with tilt, skew, lateral shift, and fore and aft movements. Fluid motors are operable to selectively raise and lower the supports to change the elevation of the spreader independent of the lift beam and provide the carrier with pile slope movements.

42 Claims, 10 Drawing Figures

10
11
12
13
14
17
19
21
-22-
-23-
26
27
29
31
42
46
51
53
59
62
63
77
78
82
84
86
87
89
93
103
109
116
118
121
123
124
128
142
163
167
174
3
3

97
109
99
171
106
169
173
172
116
119
105
131
192
187
137
117
123
122
124
127
126
23
121
51
6
133
188
189
166
118
104
128
164
167
103
92
163
168
96
89
93
109

134
133
129
118
128
144
148

LOAD CARRIER ASSEMBLY

FIELD OF INVENTION

The present invention relates to a material handling apparatus for handling heavy loads, such as cargo containers and trailers. The material handling apparatus is a load handling and transporting vehicle having a power lift operable to move a spreader adapted to be locked onto the top of a cargo container.

BACKGROUND OF INVENTION

It is a common practice to transport freight in containers. The containers are relatively large structures that are transported by rail, truck, and ship to designated locations. Material handling machines are used to move the containers in freight yards and load and unload the containers from railroad cars, ships, and trucks.

The material handling machines have spreaders adapted to be attached to the top of the containers. In one type of machine, the spreaders are pendently supported from a box-shaped frame, known as a gallows, with a plurality of chains. Hydraulic cylinders extended between a fixed member and the container are used to swing the spreaders relative to the gallows to position the container in a desired location. The gallows and suspended spreader have considerable height, so that it cannot be used in a confined environment, such as below a deck of a ship. The elevating capacity of the machine is limited to the elevated height of the lift apparatus of the machine. The gallows and spreader cannot independently lift the containers to a desired location.

A load handling mobile machine having a tall L-shaped boom is disclosed by Larsen and Robnett in U.S. Pat. No. 4,016,992. A load carriage assembly is rotatably mounted on the boom. The high profile of this machine prevents its use in restricted spaces. Copie in U.S. Pat. No. 4,268,216 discloses a load lifting and carrying machine having a load support unit attached to a spreader frame with pivoted attaching members. The load support unit has a relatively high profile which restricts its use to unconfined environments.

SUMMARY OF INVENTION

The invention is related to a load carrier assembly useable with lift means for handling a load, such as a cargo container. The assembly has a relatively low silhouette or vertical profile enabling the assembly to be used with a mobile vehicle, as a roll-on and roll-off machine for loading and unloading cargo ships and handling cargo containers above and below the deck of a cargo ship. The load carrier assembly has a first means adapted to be connected to a lift apparatus and a second means adapted to be connected to the load. Strut means interconnect the first means with the second means and permit the second means to pivot about generally horizontal and vertical axes and move in fore and aft and in lateral directions. Powered means associated with the first and second means are operable to selectively provide the second means with pivotal movements about the generally horizontal and vertical axes, as well as the fore and aft and lateral movements.

In a preferred embodiment of the invention a bridge means having generally upright members is connected to the forward ends of the lift means of a container handling vehicle. Pedestal supports are slidably mounted on the upright members. Power operated means mounted on the bridge means function to selectively raise and lower the pedestal supports, whereby the container can be independently elevated of the lift means of the vehicle. A spreader is located over the top of the container. The spreader has end members supporting releasable twist locks adapted to be turned into locking engagement with corner blocks of the container. The spreader has a plurality of longitudinal members that extend toward the vehicle. Upright strut means support the spreader on the pedestal supports. The strut means comprise a pair of upright struts having generally cylindrical upper and lower balls seated in sockets in the pedestal supports and blocks secured to the longitudinal members. The power operated means comprise a pair of power units that are simultaneously operated to raise or lower the spreader. Each power unit can be individually operated to pivot the spreader about a generally horizontal longitudinal axis to provide the spreader with pile slope movement. The power units are operable to selectively pivot the spreader in opposite directions about its horizontal longitudinal axis.

First extendible and contractible means, such as a pair of hydraulic first double acting hydraulic cylinders, connected to the pedestal supports and the longitudinal members function to pivot the spreader on the upper balls of the strut means about a generally horizontal axis. Extension of the hydraulic cylinders causes the spreader to tilt downwardly. Contraction of the hydraulic cylinders causes the spreader to tilt upwardly.

Second extendible and contractible means, such as a pair of second double acting hydraulic cylinders, connected to the pedestal supports and struts are operable to provide the spreader with fore and aft movements and rotational movement about a generally upright axis, known as skew movement. Concurrent extension of the second hydraulic cylinders causes fore movement of the spreader and contraction of these cylinders causes aft movement. The skew movement is caused by extending one hydraulic cylinder and contracting the other hydraulic cylinder. This results in pivotal movements of the separate struts in opposite directions thereby rotating the spreader about a generally upright axis.

Third extendible and contractible means, such as a third hydraulic cylinder, located in a lateral position is connected to the longitudinal members and one pedestal support. The third double acting hydraulic cylinder is operable to provide the spreader with lateral or sideways movement. This movement is known as a side shift. The side shift can be to the right or left.

The container handling assembly is useable with a mobile vehicle having lift means with relatively low vertical profile. The container handling assembly does not increase the height or vertical profile of the vehicle, thus, allowing the vehicle to be used in confined spaces, such as below the deck of a cargo ship. Conventional cargo containers can be stacked below the deck of a ship with a low profile vehicle equipped with the container handling assembly.

The container handling apparatus is an animated arrangement of support strut means and control extendible and contractible means operable to permit the operator to provide the container with three axis or gimbal movements, such as tilt, fore, and aft or extension, skew, side shift, pile slope, and vertical elevation movements. This control of the spreader allows the operator to place the container in a relatively confined space.

The lift means of the vehicle operates to raise a container so that it can be stacked three high. The container handling assembly, with its additional lift apparatus, is operable to further elevate the container so that it can be stacked four high.

IN THE DRAWINGS

DESCRIPTION OF PREFERRED EMBODIMENT

Figure 1:
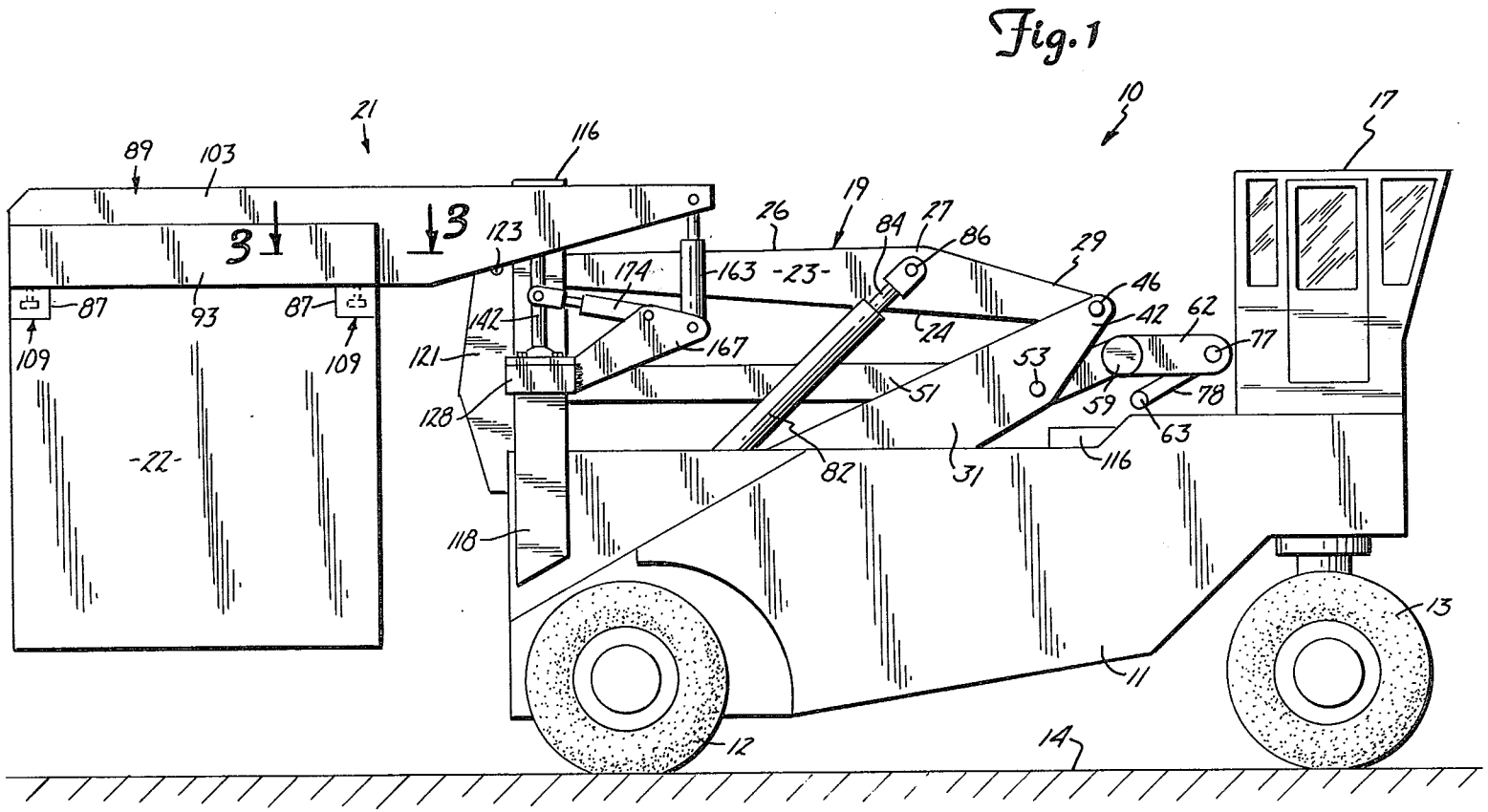
FIG. 1 is a side elevational view of a mobile container handling vehicle equipped with a load handling apparatus and load carrier assembly attached to a cargo container.

Referring to FIG. 1, there is shown a mobile land vehicle indicated generally at 10. Vehicle 10 is described in detail in co-pending U.S. Application Ser. No. 349,182, filed Feb. 17, 1982. This Application is incorporated herein by reference. Vehicle 10 has a generally horizontal frame 11 supported on ground 14 with a pair of front drive wheels 12 and a pair of rear steering wheels 13. Vehicle 10 has an internal combustion engine 16 operatively connected to drive wheels 12 with a power transmission and differential assemblies (not shown). A low profile operator cab 17 is mounted on the rear portion of frame 11 adjacent a steering control assembly (not shown) for steering wheels 13. The overall height of vehicle 10, including cab 17, is such that it can be used below the deck of a cargo ship to handle and stack cargo containers.

A load handling apparatus indicated generally at 19 is operably mounted on frame 11 in front of cab 17. Apparatus 19 is a low silhouette beam and linkage assembly that supports a load lift structure or load carrier assembly indicated generally at 21 used to handle a cargo container 22. Load handling apparatus 19 and associated load carrier assembly 21 have a low silhouette so that vehicle 10 is operable to transport and stack cargo containers in a relatively confined area, such as below the deck of a cargo ship.

Apparatus 19 has a main lift beam 23 having a bottom wall 24, top wall 26, an apex 27, and rear end 29. A first link 31 is located below beam 23. Link 31 has a rear end 42 accommodating a pivot pin 46 connecting beam 23 to link 31. A control beam 51 located between beam 23 and link 31 is pivoted with pin 53 to link 31. Beam 51 has a cross member 59 attached to arms 62. Pivot pins 77 connect arms 62 to a second link assembly 63 having a rod 78 and a double acting hydraulic cylinder (not shown). A pair of lift hydraulic cylinders 82 pivoted to frame 11 with pins operate to move beams 23 and 51 and link 31 from a low nested position, shown in FIG. 1, to an extended elevated position. Cylinders 82 have rods 84 connected to pins 86 extended laterally from the apex 27 of beam 23.

Vehicle 10 is used in yards and ship terminals to transport, lift, and stack cargo containers. Cargo containers are removed from docks, ships, and barges and stacked in storage locations. Load carrier assembly 21 has a relatively low silhouette or vertical profile permitting the vehicle to be used as a roll-on and roll-off vehicle for loading and unloading cargo ships. The low silhouette of the load carrier assembly 21 allows the machine to be used to stack cargo containers two high below the deck of a ship and four high on the deck and dock. Vehicle 10 is one type of mobile machine that can be used with the cargo carrier assembly 21. Other types of load lifting machines having low vertical masts can be used with the load carrier assembly 21 to handle cargo containers, trailers, and the like.

Figure 2:
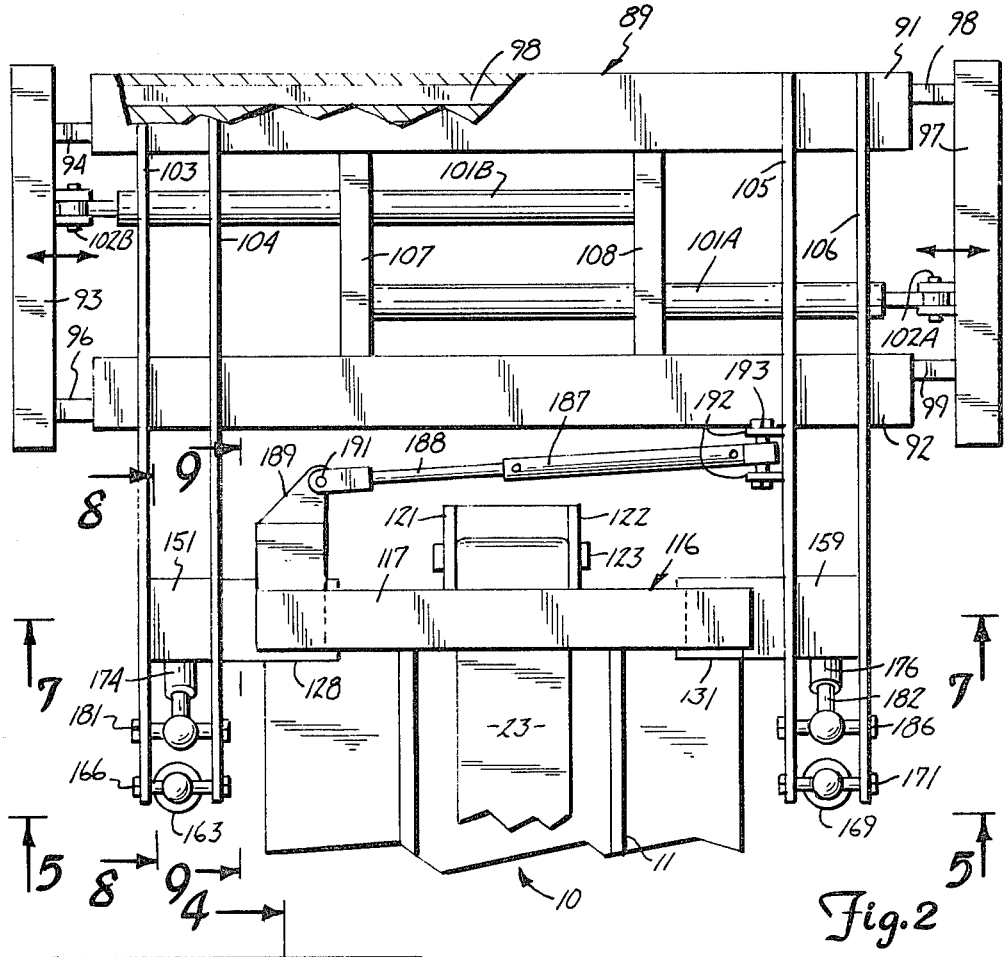
FIG. 2 is a fragmentary top view of the load carrier assembly of FIG. 1.

As shown in FIGS. 1 and 2, load carrier assembly 21 has a spreader indicated generally at 89 located over the top of container 22. Spreader 89 comprises a pair of transverse beams 91 and 92 located between first and second end members 93 and 97. A pair of first arms 94 amd 96 secured to first end member 93 extend into passages in beams 91 and 92 to movably mount the end member on beams 91 and 92. A pair of second arms 98 and 99 secured to end member 97 are reciprocally disposed in passages in the opposite ends of beams 91 and 92. A hydraulic cylinder 101A is connected to member 107 and with a pivot 102A to end member 97. Another hydraulic cylinder 101B is connected to member 108 and with pivot pin 102B to end member 93. Cylinders 101A and 101B are double acting and operate to move end members 93 and 97 toward and away from the ends of beams 91 and 92. Hydraulic cylinders 101A and 101B are operable to locate end members 93 and 97 adjacent the ends of container 22. The containers have lengths between 6.5 and 12.3 meters. The end members 93 and 97 are laterally movable to accommodate these containers.

A plurality of linear connecting members 103, 104, 105, 106, 107, and 108 extend between and are secured to beams 91 and 92. Members 103–108 laterally space beams 91 and 92 from each other. Members 103, 104, 105, and 106 are generally horizontal and extend a short distance above beams 91 and 92 so as to maintain the low silhouette of spreader 89.

Figure 3:
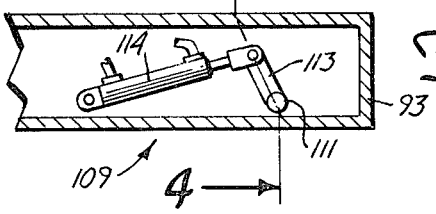
FIG. 3 is an enlarged sectional view taken along the line 3—3 of FIG. 1.
Figure 4:
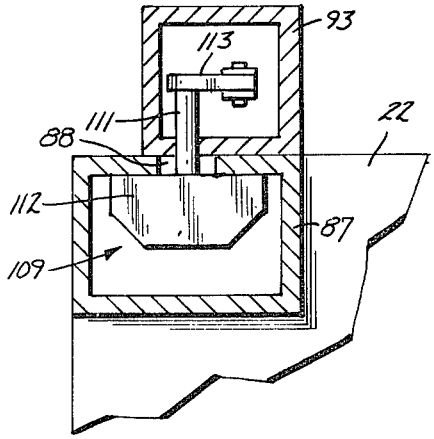
FIG. 4 is a sectional view taken along the line 4—4 of FIG. 3.

As shown in FIG. 1, end member 93 has twist lock assemblies 109 that lock into corner blocks 87. Referring to FIGS. 3 and 4, lock assembly 109 has a vertical shaft 111 rotatably mounted on end member 93. A foot 112 is secured to the lower end of shaft 111. Foot 112 is adapted to be moved through an elongated slot 88 and turned 90 degrees to connect end member 93 to corner block 87. An upper end of shaft 111 is secured to an arm 113 attached to a hydraulic cylinder 114. Hydraulic cylinder 114 is operable to rotate foot 112 about the axis of shaft 111 into locking and unlocking relationship relative to corner block 87. The lock assembly 109 is disengaged from the corner block 87 by rotating foot 112 90 degrees into alignment with slot 88. Foot 112 is withdrawn from block 87.

Figure 5:
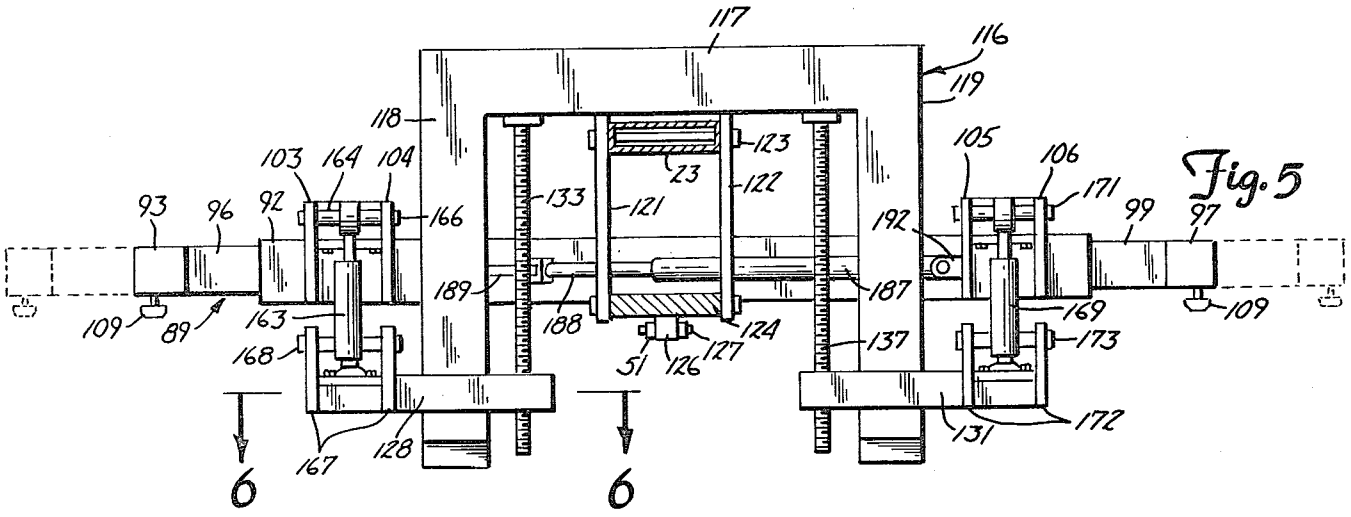
FIG. 5 is an enlarged sectional view taken along the line 5—5 of FIG. 2.
Figure 6:
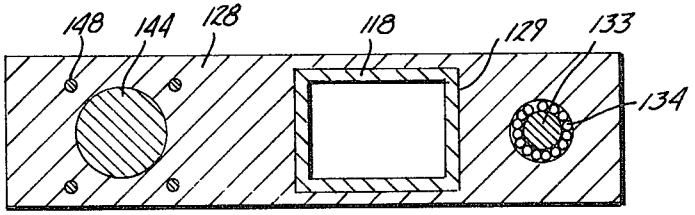
FIG. 6 is an enlarged sectional view taken along the line 6—6 of FIG. 5.

Referring to FIGS. 2 and 5, a bridge indicated generally at 116 is mounted on the forward ends of the main lift beam 23 and control beam 51. Bridge 116 is an inverted U-shaped member having a transverse horizontal base 117 secured at its opposite ends to downwardly extended side members 118 and 119. A pair of downwardly directed supports 121 and 122 are secured to the mid-section of base 117. A first pin 123 connects the forward end of main lift beam 23 to supports 121 and 122. The lower end of supports 121 and 122 is secured to a cross member 124 having a downwardly extended ear 126. A second pin 127 pivotally connects the forward end of control beam 51 to ear 126.

As shown in FIG. 5, a pedestal support or block member 128 is slidably mounted on side member 118. Pedestal support 128 has an upright passage 129 slidably accommodating side member 118. A second pedestal support 131 is slidably mounted on side member 119. Pedestal support 131 has an upright passage 132 accommodating side member 118. Supports 128 and 129 are simultaneously movable relative to side members 118 and 119 to change the elevation of spreader 89 to permit the stacking of cargo containers four high. This is accomplished without additional lift from apparatus 19.

Figure 7:
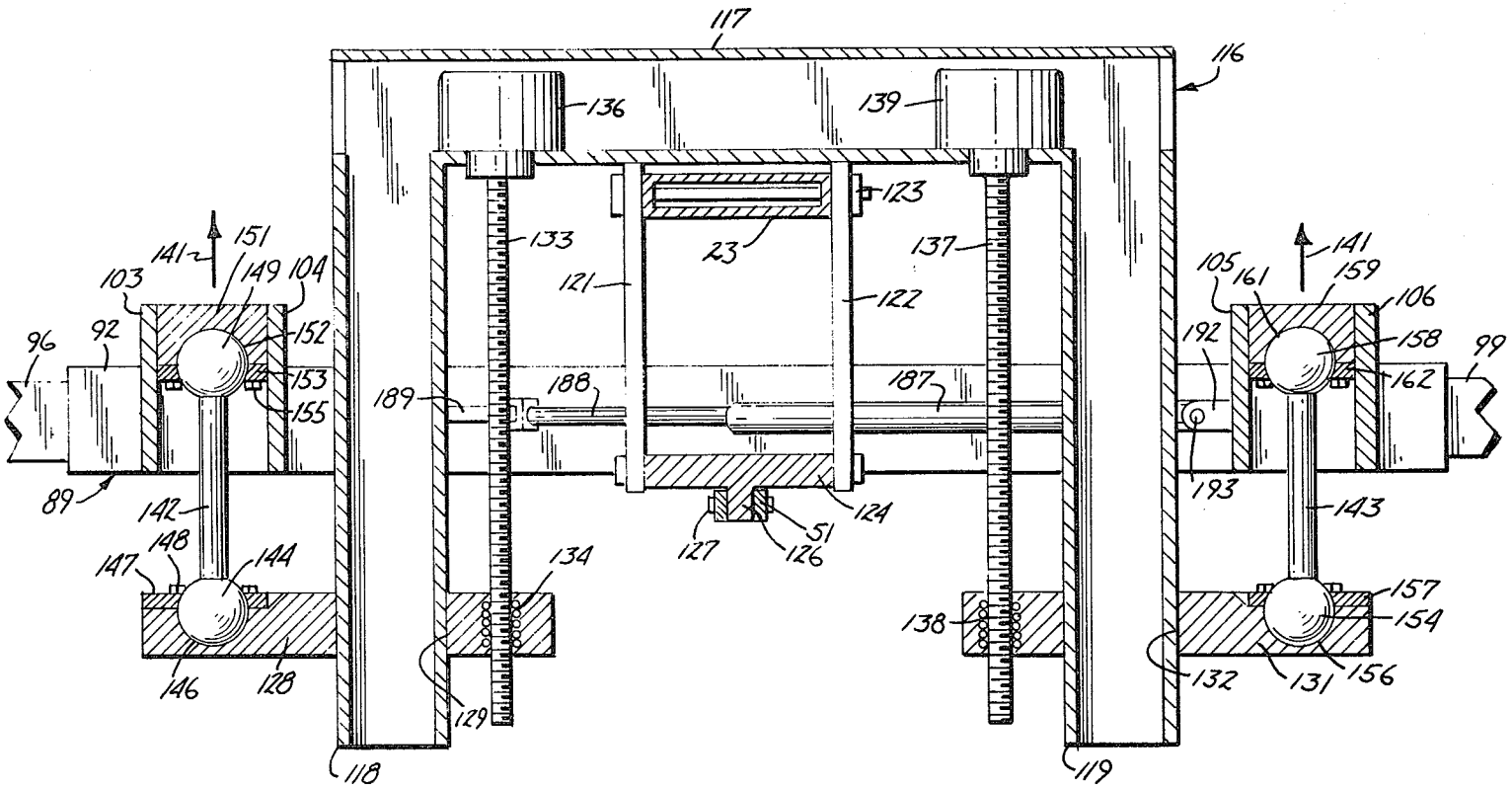
FIG. 7 is an enlarged sectional view taken along the line 7—7 of FIG. 2.

As shown in FIG. 7, a pair of power operated units operate to selectively raise or lower the supports 128 and 129. The first power operated unit has a first worm 133 extended downwardly and threaded through a low friction ball screw 134 in support 128. The upper end of worm 133 is connected to a hydraulic motor 136 mounted within base 117. The second power operated unit has a second downwardly directed second worm 137 threaded into a ball screw 138 in pedestal 131. Upper end of worm 137 is drivably connected to a second hydraulic motor 139 located within base 117. Hydraulic motors 136 and 139 are simultaneously operated to concurrently rotate worms 133 and 137 simultaneously move supports 128 and 131, as indicated by the arrows 141. Hydraulic motors 136 and 139 are reversible so that supports 128 and 131 can be selectively raised and lowered relative to bridge 116. Hydraulic motors 136 and 139 can be individually operated to raise one support 128 or 131. Both motors 136 and 139 can be operated to raise one support and lower the other support. This provides the spreader 89 with pile slope movement or pivotal movement about a generally horizontal longitudinal axis. Other types of extendible and contractible power units can be used to move and hold the supports 128 and 131 in desired positions on the bridge 116.

Spreader 89 is movably supported on supports 128 and 131 with a pair of upwardly directed struts 142 and 143. Strut 142 has a lower ball 144 located within a socket 146 on the upper side of support 128. An annular ring or retainer 147 surrounds ball 144 to hold the ball in articulated assembled relation with support 128. A plurality of bolts 148 secure retainer 147 to support 128. The upper end of strut 142 has an upper ball 149 bearing against a block 151 secured to members 103 and 104. The lower side of block 151 has a socket 152 accommodating upper ball 149. An annular retainer 153 surrounding ball 149 is secured to block 151 with bolts 155 to hold ball 149 in articulated assembled relation with block 151.

The second strut 143 has a lower ball 154 located in a socket 156 in pedestal support 131. An annular retainer 157 surrounding ball 154 is secured to pedestal support 131 to hold the strut in assembled relation with support 131. The upper end of strut 143 has an upper ball 158 bearing against a block 159 secured to members 105 and 106. Block 159 has a downwardly open socket 161 accommodating ball 158. An annular retainer ring 162 surrounding ball 158 secured to block 159 holds strut 143 in moving assembled relation with block 159. Struts 142 and 143 allow three axis or gimbal movements of spreader 89.

Figure 8:
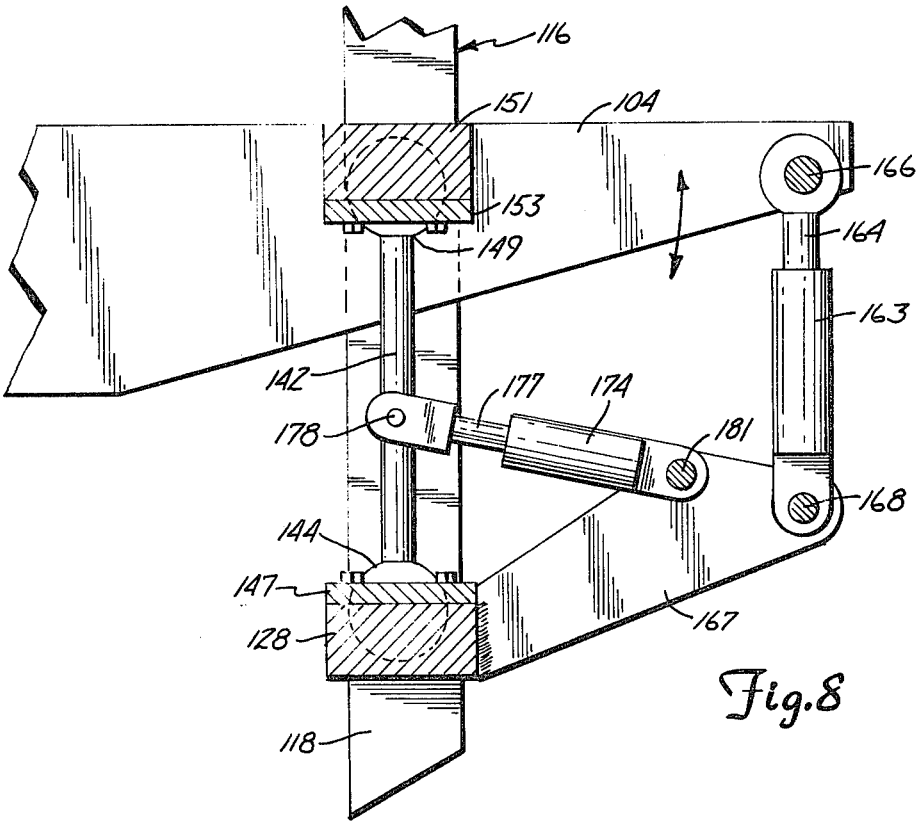
FIG. 8 is an enlarged sectional view taken along the line 8—8 of FIG. 2.

Referring to FIGS. 5 and 8, first extendible and contractible means comprise at least one tilting power member, shown as a first double acting hydraulic cylinder. In this embodiment, the first means comprise a first double acting hydraulic cylinder 163 and a second double acting hydraulic cylinder 169, operable to pivot spreader 89 about a transverse horizontal axis. Spreader 89 pivots on upper balls 149 and 158 of struts 142 and 143 thereby tilting the spreader either up or down. First hydraulic cylinder 163 has an upwardly directed rod 164 connected with a pivot pin 166 to the inner ends of the members 103 and 104. The lower end of cylinder 163 is pivotally connected to upwardly and rearwardly directed arms 167 secured to support 128. A pivot pin 168 pivotally connects cylinder 163 to arms 167. Spherical bearings mounted on pins 166 and 168 connect opposite ends of hydraulic cylinder 163 to the pins. The bearings allow the spreader 89 freedom to move fore and aft, laterally or side shift, and rotate about a generally upright axis. The second hydraulic cylinder 169 is connected with a pin 171 to the rear ends of members 105 and 106. The lower end of cylinder 169 is connected to upwardly and rearwardly directed arms 172 with a pin 173. Arms 172 are secured to support 131.

Operation of one or both hydraulic cylinders 163 and 169 affects the tilting action of spreader 89 and container 22 locked thereto in both the downward and forward tilt direction and upward and forward tilt direction.

Referring to FIGS. 2 and 8, second extendible and contractible means comprising a pair of double acting hydraulic cylinders 174 and 176 are operatively connected to arms 167 and 172 and struts 142 and 143 to effect fore and aft movements of spreader 89 and skew movement of spreader 89. The skew movement of spreader 89 comprises rotation about a generally upright axis in both clockwise and counterclockwise directions. This control of spreader 89 allows container 22 to be placed on top of another container when vehicle 10 is at an angle other than 90 degrees relative to the other container.

As shown in FIG. 8, hydraulic cylinder 174 has a rod 177 pivoted to the mid-section of strut 142 with a pin 178. The lower end of cylinder 174 is pivotally connected to arms 167 with a pivot pin 181. Arms 167 are secured to support 128. The second hydraulic cylinder 176 has a rod 182 pivotally connected to the mid-section of strut 143 with pin (not shown). The lower end of cylinder 176 is connected to arms 172 with a pivot pin 186. Arms 172 are secured to support 131.

In use, when hydraulic cylinders 174 and 176 are simultaneously extended, struts 142 and 143 are angularly moved in a forward direction, thereby moving spreader 89 away from vehicle 10. When hydraulic cylinders 174 and 176 are contracted, spreader 189 moves inwardly or toward vehicle 10. Thus, container 22 carried by spreader 89 is selectively movable to fore and aft positions to facilitate the stacking of the container in a desired location. When one cylinder 174 or 176 is extended and the other cylinder contracted, the spreader 89 swings about an upright axis. This provides container 22 with skew movement. Cylinders 174 and 176 can be positioned in other locations to provide spreader 89 with fore and aft and skew movements. For example, cylinders 174 and 176 can be connected to spreader beam 92 and pedestal supports 128 and 131.

Figure 9:
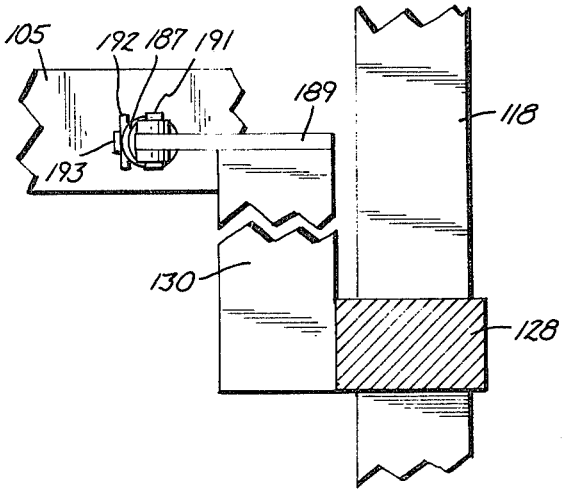
FIG. 9 is an enlarged sectional view taken along the line 9—9 of FIG. 2.

Returning to FIGS. 2 and 9, spreader 89 is provided with lateral shifting movements in opposite lateral directions with a third extendible and contractible means comprising a double acting hydraulic cylinder 187. Cylinder 187 has a movable piston rod 188 connected to a bracket 189 with a pivot pin 191. Bracket 189 is mounted on an upright extension 130 of pedestal support 128. The opposite end of cylinder 187 is pivotally connected to ears 192 with a pin 193. The ears 192 are secured to the inside of member 105. Cylinder 187 extends in a general horizontal direction in front of bridge 116.

In use, when cylinder 187 is extended, the spreader 189 is moved to the right, as viewed in FIG. 2. When cylinder 187 is contracted, spreader 189 moves in an opposite direction or to the left, as viewed in FIG. 2. This movement allows container 22 to be laterally shifted to a desired lateral location.

Figure 10:
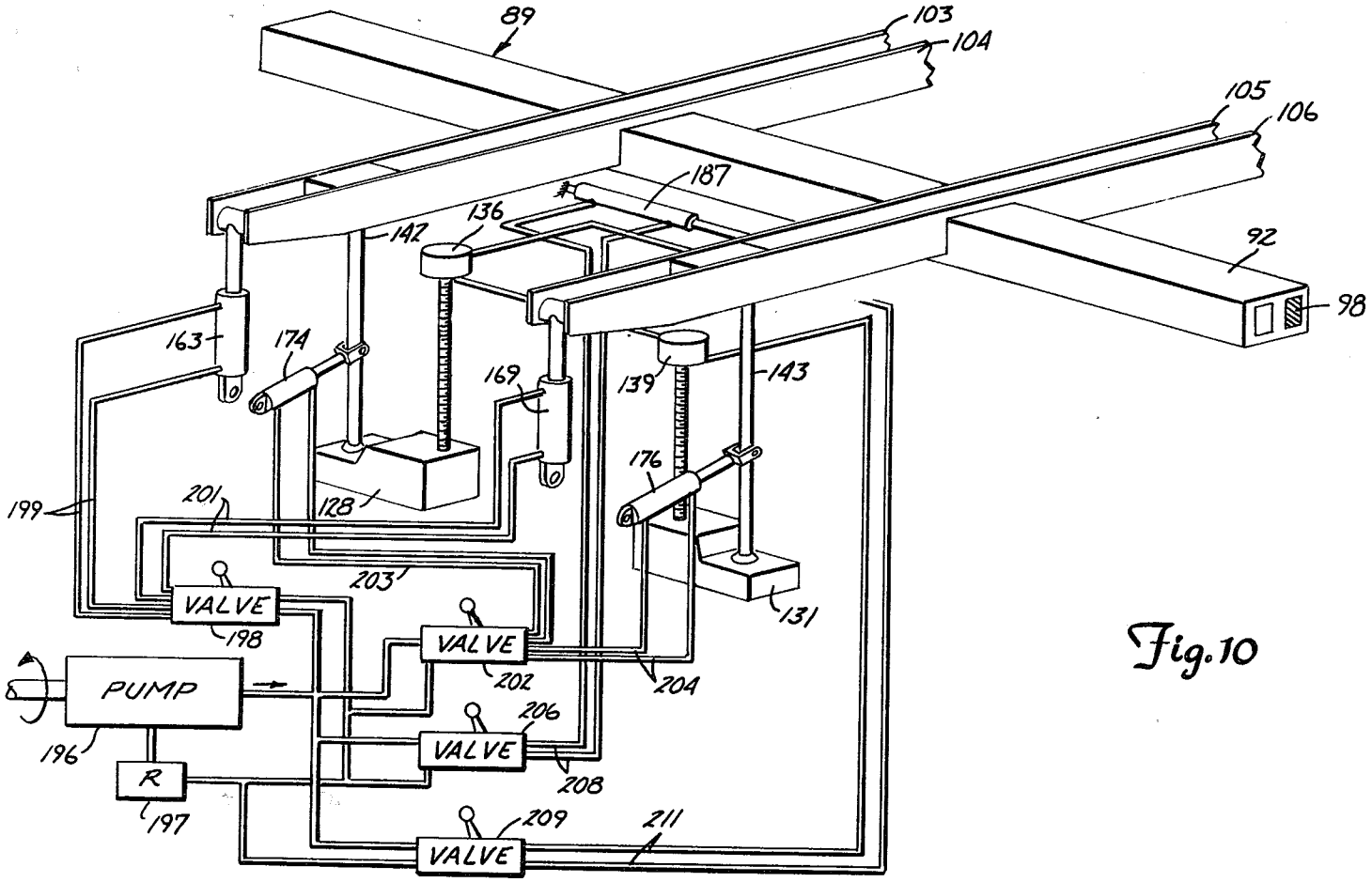
FIG. 10 is a diagrammatic view of the hydraulic control system for the carrier assembly.

Referring to FIG. 10, there is shown a diagrammatic view of the fluid supply system for selectively operating the hydraulic cylinders 163, 169, 174, 176, 187, and fluid motors 136 and 139. A pump 196 driven by the vehicle's engine draws hydraulic fluid from a reservoir 197 and discharges the fluid to a plurality of manually operated valves 198, 202, 206, and 209.

Valve 198 delivers fluid under pressure to lines 199 and 201 leading to the hydraulic cylinders 163 and 169. Valve 202 is operable to selectively supply fluid under pressure to cylinders 174 and 176 to concurrently or separately expand or contract these cylinders. Valve 202 is connected to lines 203 and 204 and delivers the fluid under pressure to the hydraulic cylinders 174 and 176. Valve 202 is operable to selectively supply fluid to cylinders 174 and 176 to concurrently or separately expand or contract the cylinders. Valve 206 is connected to lines 208 leading to the lateral extension cylinder 187. Valve 206 functions to selectively provide fluid under pressure to cylinder 187 to expand or contract this cylinder, and thereby laterally move spreader 89 in opposite directions. Fourth valve 209 is connected to lines 211 leading to fluid motors 136 and 139. Valve 209 is manually operable to provide fluid under pressure to motors 136 and 139 to selectively operate these motors in opposite directions to control the elevation of the supports 128 and 131. Valve 209 is also operable to individually actuate the motor 136 or motor 139 to laterally tilt or pile slope spreader 89. All of the valves 198, 202, 206, and 209 are connected with suitable lines to reservoir 197 to complete the hydraulic circuit.

In use, mobile vehicle 10 having a load carrier assembly 21 transports and stacks cargo containers in desired locations, such as a storage yard and weather deck, or below deck of a ship. The carrier assembly 21 has a spreader 89 that can accommodate a conventional cargo container. These containers are designed to be picked up from the top. The twist lock assemblies 109 on spreader 89 are operable to lock into the corner blocks of the containers so that the containers move with spreader 89.

Load handling apparatus 19 of vehicle 10 is operable to raise the carrier assembly 21 and thereby lift container 22 off the ground. Vehicle 10 is then driven to transport container 22 to a desired location. Load handling apparatus 10 can then be lowered to place the container on the ground. In the event that container 22 is to be placed on top of an existing container, the load handling apparatus 19 is elevated and the vehicle is moved to locate the container 22 generally above the existing container. The fore and aft hydraulic cylinders 174 and 176 can be actuated to longitudinally position the container. The side shift hydraulic cylinder 187 can be operated to laterally shift the container to a desired location. When the vehicle is located on an inclined support, such as a ramp of a cargo ship, the tilt cylinders 163 and 169 are operated to tilt the spreader 89 to a generally horizontal position. This is accomplished by expanding the cylinders 163 and 169, causing spreader 89 to pivot on the upper ends of the struts 142 and 143.

The spreader 89 and cargo container 22 locked thereto can be rotated about a generally vertical axis or skewed by the action of the hydraulic cylinders 174 and 176. When hydraulic cylinder 174 is extended and cylinder 176 is contracted, the spreader 89 has a skewed clockwise movement. When cylinder 176 is extended and cylinder 174 is contracted, the spreader 89 has a counterclockwise skewed movement.

The transverse incline or pile slope of the spreader 89 and container 22 attached thereto is controlled by fluid motors 136 and 139. When one of these motors is operated in one direction and the other motor stopped or operated in a direction opposite the first motor, the spreader 89 rotates about a generally horizontal longitudinal axis. This moves opposite ends of the container 22 up and down.

Referring to FIG. 5, spreader 89 can be elevated to stack container 22 four high. The load handling apparatus 19 is extended to its full up position. This locates container 22 in a location where it can be stacked three high. Additional elevation of the container 22 is achieved by moving supports 128 and 131 upwardly relative to bridge 116. This is accomplished by the concurrent operation of hydraulic motors 136 and 139. Motors 136 and 139 rotate worms 133 and 137, thereby moving supports 128 and 131 in an upward direction. Struts 142 and 143 being anchored on supports 128 and 131 move spreader 189 in an upward direction, thereby locating the container 22 in a position whereby it can be stacked four high on the weather deck of a ship or in the yard. After container 22 is stacked, locks 109 are released. Spreader 89 is moved away from the stacked container by moving vehicle 10. The hydraulic motors 136 and 139 are reversed to locate spreader 89 in its lowest position. The load handling apparatus 19 is moved from its up position to its folded or down position. The vehicle 10 is then moved to location to pick up a second container.

While there has been shown and described the preferred embodiment of the mobile vehicle and load carrier assembly, it is understood that changes in the structure, materials, and arrangement of structure may be made by those skilled in the art without departing from the invention. The invention is defined in the following claims.

I claim:

1. A cargo container handling assembly useable with a mobile lift vehicle having lift means to move a cargo container to a desired location comprising: first means including support means, said support means comprises vertically movable supports, means operably connected to the vertically movable supports to selectively raise and lower said supports, spreader means having means adapted to be secured to the cargo container, said means connected to the supports operable to rotate the spreader means about a longitudinal horizontal axis to change the transverse slope of the container, strut means engageable with the support means and extended in a generally upright direction, means connecting the strut means to said spreader means, first power operated means connected to the support means to pivot the spreader means about a generally horizontal axis whereby the container can be selectively tilted in an upward or downward direction, second power operated means connected to the support means selectively operable to move the spreader means toward and away from the lift means and rotate the spreader means about a generally upright axis, thereby providing the container with fore and aft movement and skewed movements, and third power operated means connected to the support means operable to laterally move the spreader means relative to the mobile lift means.

2. The assembly of claim 1 wherein: said strut means includes a first strut having a lower ball and a second strut having a lower ball, said lower balls being mounted on the support means.

3. The assembly of claim 2 wherein: each of said struts has an upper ball, said means connecting the strut means includes means accommodating the upper balls thereby allowing said spreader means three axis movement.

4. The assembly of claim 1 wherein: said means operably connected to the vertically movable supports includes fluid motor means operable to selectively raise and lower the supports thereby raising and lowering the spreader means.

5. The assembly of claim 4 wherein: said means operably connected to the vertically movable supports includes worm means connected to the fluid motor means and vertically movable supports whereby on operation of the fluid motor means the worm means selectively raises and lowers the vertically movable supports.

6. The assembly of claim 1 wherein: said strut means includes a first strut having a lower ball movably supported on a support and an upper ball, a second strut having a lower ball movably supported on another support, and an upper ball, and said means connecting the strut means to said spreader means including block means having pockets for accommodating the upper balls.

7. The assembly of claim 1 including: bridge means adapted to be connected to the lift means, said bridge means having a pair of upright members, said supports being slidably mounted on each upright member, and said means operably connected to the vertically movable supports being mounted on the bridge means to move the vertically movable supports relative to the upright members.

8. The assembly of claim 7 wherein: said means mounted on the bridge means includes a fluid motor means, and means operated by the fluid motor means to selectively raise and lower the vertically movable supports on said upright members.

9. The assembly of claim 8 wherein: said means operated by the fluid motor means includes worm means operably connected to the supports.

10. A cargo container handling assembly useable with a mobile lift having lift means to move a cargo container to a desired location comprising: first means adapted to be connected to the lift means, said first means including support means, spreader means having means adapted to be secured to the cargo container, strut means engageable with the support means and extended in a generally upright direction, means including a plurality of longitudinal members, connecting the strut means to said spreader means, means secured to said members movably accommodating said strut means, first power operated means connected to the support means to pivot the spreader about a generally horizontal axis whereby the container can be selectively tilted in an upward or downward direction, said first power operated means being secured to said longitudinal members, second power operated means connected to the support means selectively operable to move the spreader means toward and away from the lift means and rotate the spreader means about a generally upright axis thereby providing the container with fore and aft movements and skewed movements, and third power operated means connected to the support means operable to laterally move the spreader means relative to the mobile lift means.

11. The assembly of claim 10 wherein: said means secured to said members includes block means having concave curved pockets, said strut means having upper spherical ends located in said pockets.

12. The assembly of claim 10 wherein: said first power operated means comprises at least one first extendible and contractible unit.

13. The assembly of claim 12 wherein: said first extendible and contractible unit comprise a fluid operated double acting cylinder.

14. The assembly of claim 12 wherein: said second extendible and contractible means comprise a pair of fluid operated double acting cylinders.

15. The assembly of claim 10 wherein: said second power operated means comprises a pair of second extendible and contractible means.

16. The assembly of claim 15 wherein: said unit of the third power operated means is a fluid operated double acting hydraulic cylinder.

17. The assembly of claim 10 wherein: said third power operated means comprises an extendible and contractible unit.

18. A cargo container handling assembly useable with a mobile lift vehicle having lift means to move a cargo container to a desired location comprising: first means adapted to be connected to the lift means, said first means including support means, spreader means having means adapted to be secured to the cargo container, strut means engageable with the support means connecting the strut means to said spreader means, first power operated means connected to the support means to pivot the spreader means about a generally horizontal axis whereby the container could be selectively tilted in an upward or downward direction, second power operated means connected to the support means selectively operable to move the spreader means toward and away from the lift means and rotate the spreader means about a generally upright axis, thereby providing the container with fore and aft movement and skewed movements, and third power operated means connected to the support means operable to laterally move the spreader means relative to the mobile lift means, said first power operated means comprises at least one fluid operated double acting cylinder pivotally connected to said support means and said means connecting the strut means to said spreader means, said second power operated means comprising a second pair of fluid operated double acting cylinders pivotally connected to said strut means and said support means, said third power operated means comprising a fluid operated double acting cylinder connected to the support means and means connected to the spreader means, and a plurality of valve means for selectively controlling of fluid under pressure to said double acting hydraulic cylinders.

19. The assembly of claim 18 wherein: said spreader means includes end means laterally adjustable to accommodate containers having different lengths, and power means operable to selectively extend or contract said end means to accommodate the length of the load.

20. The assembly of claim 19 including: releasable lock means associated with each end means adapted to lock onto said containers, said lock means including power operated means for selectively moving the lock means between locked and unlocked positions.

21. The assembly of claim 18 including: means connecting the first power operated means to the means connected to the spreader means, means connecting the second power operated means to the strut means, and means connecting the third power operated means to the means connected to the spreader means.

22. A load carrier assembly useable with a load handling apparatus for transporting and raising and lowering a load comprising: first means adapted to be connected to the load handling apparatus, second means adapted to be attached to the load, strut means movably supporting the second means on the first means whereby the second means can pivot and rotate relative to said strut means providing the second means with movement about horizontal and vertical axes and fore and aft and lateral movements, and powered means connected to the second means selectively operable to move the second means in a manner to provide said movement about the horizontal and vertical axes and said fore and aft and lateral movements, said second means including beam means and a plurality of longitudinal members secured to said beam means, block members secured to said longitudinal members for accommodating upper ends of said strut means, and means connecting said powered means to said longitudinal members.

23. The assembly of claim 22 wherein: said second means includes spreader means adapted to be positioned over said load, and lock means associated with the spreader means to lock onto said load whereby said load moves with said spreader means.

24. The assembly of claim 23 wherein: said spreader means includes end means laterally adjustable to accommodate loads having different lengths, and power means operable to selectively extend or contract said end means to accommodate the length of the load.

25. The assembly of claim 20 including: releasable lock means associated with each end means adapted to lock onto said load, said power and lock means including power operated means for selectively moving the lock means between locked and unlocked positions.

26. The assembly of claim 22 wherein: said strut means includes a pair of generally upright struts, each strut having a generally spherical lower member and a generally spherical upper member providing the second means with three axis movement, said first means having support means accommodating said lower generally spherical member, and said second means having block means accommodating said generally spherical upper member of each strut.

27. The assembly of claim 22 wherein: said powered means includes a first extendible and contractible means operably connected to the first and second means operable to pivot the second means about a generally horizontal axis on said strut means thereby providing the second means with a tilt motion, second extendible and contractible means connected to the first means and strut means operable to provide the second means with fore and aft movement and rotational movement about a generally upright axis, and third extendible and contractible means connected to the first and second means to provide the second means with lateral movement.

28. The assembly of claim 27 wherein: each of said extendible and contractible means includes fluid operated double acting cylinder means, and means for selectively controlling the flow of fluid under pressure to said cylinder means.

29. The assembly of claim 22 wherein: said first means includes vertically and independently movable means supporting said strut means, and second powered means operably connected to the vertically movable means to selectively raise and lower said vertically movable means.

30. The assembly of claim 29 wherein: said second powered means operably connected to the vertically movable means includes fluid motor means operable to selectively raise and lower the vertically movable means.

31. The assembly of claim 30 wherein: said means operably connected to the vertically movable means includes worm means connected to the fluid motor means and vertically movable means whereby on operation of the fluid motor means the worm means selectively raises and lowers the vertically movable means.

32. The assembly of claim 29 including: bridge means adapted to be connected to the load handling apparatus, said bridge means having a pair of upright members, said vertically movable means being slidably mounted on said upright members, said second powered means being mounted on the bridge means and operably connected to the vertically movable means to move the vertically movable means relative to the upright members.

33. The assembly of claim 32 wherein: said second powered means includes a fluid motor means, means operated by the fluid motor means to selectively raise and lower the vertically movable means on said upright members, and means for selectively controlling the flow of fluid under pressure to said fluid motor means.

34. The assembly of claim 32 wherein: said first powered means includes a first extendible and contractible means operably connected to the first and second means operable to pivot the second means about a generally horizontal axis on said strut means thereby providing the second means with a tilt motion, second extendible and contractible means connected to the first means and strut means operable to provide the second means with fore and aft movement and rotational movement about a generally upright axis, and third extendible and contractible means connected to the first and second means to provide the second means with lateral movement.

35. The assembly of claim 34 wherein: each of said extendible and contractible means includes fluid operated double acting cylinder means, and means for selectively controlling the flow of fluid under pressure to said cylinder means.

36. A load carrier assembly useable with a load handling apparatus for transporting and raising and lowering a load comprising: first means adapted to be connected to the load handling apparatus, said first means including support means having linear vertically movable supports, means operably connected to the vertically movable supports to selectively raise and lower said supports, second means including a spreader frame means adapted to be attached to the load, said means connected to the supports operable to rotate the second means about a longitudinal horizontal axis to change the transverse slope of the load, strut means movably supporting the second means on the first means whereby the second means can pivot and rotate relative to said strut means providing the second means with movement about horizontal and vertical axes and fore and aft and lateral movements, and powered means connected to the second means selectively operable to move the second means in a manner to provide said movement about the horizontal and vertical axes and said fore and aft and lateral movements.

37. The assembly of claim 36 wherein: said means operably connected to the vertically movable supports includes fluid motor means operable to selectively raise and lower the supports thereby raising and lowering the second means adapted to be attached to the load.

38. The assembly of claim 36 wherein: said spreader frame means is adapted to be positioned over said load, and means associated with the spreader means to connect the load to the spreader means.

39. The assembly of claim 36 wherein: said strut means includes a pair of generally upright struts, each strut having a generally spherical lower member and a generally spherical upper member providing the second means with three axes movement, said support means having means accommodating said lowered generally spherical members, and said second means having means accommodating said generally spherical upper members of said struts.

40. The assembly of claim 36 wherein: said powered means includes a first extendible and contractible means operably connected to the first and second means operable to pivot the second means about a generally horizontal axis on said strut means thereby providing the second means with a tilt motion, second extendible and contractible means connected to the first means and strut means operable to provide the second means with the fore and aft movement and rotational movement about a generally upright axis, and third extendible and contractible means connected to the first and second means to provide the second means with lateral movement.

41. The assembly of claim 36 wherein: said second means includes beam means and a plurality of longitudinal member secured to said beam means, block members secured to said longitudinal members for accommodating upper ends of said strut means, and means connecting said powered means to said longitudinal members.

42. The assembly of claim 36 including: bridge means adapted to be connected to the load handling apparatus, said bridge means having a pair of upright members, said supports being slidably mounted on each upright member, said means operably connected to the vertically movable supports being mounted on the bridge means to move the vertically movable supports relative to the upright members.

* * * * *